US012629577B1

(12) United States Patent
Dwyer

(10) Patent No.: US 12,629,577 B1
(45) Date of Patent: May 19, 2026

(54) TETHER BALL TYPE GAME SYSTEM

(71) Applicant: Steven Dwyer, Madison, CT (US)

(72) Inventor: Steven Dwyer, Madison, CT (US)

( * ) Notice: Subject to any disclaimer, the term of this patent is extended or adjusted under 35 U.S.C. 154(b) by 394 days.

(21) Appl. No.: 18/242,428

(22) Filed: Sep. 5, 2023

Related U.S. Application Data

(60) Provisional application No. 63/403,850, filed on Sep. 5, 2022.

(51) Int. Cl.
*A63B 69/00* (2006.01)
*A63B 67/10* (2006.01)

(52) U.S. Cl.
CPC ..... *A63B 69/0079* (2013.01); *A63B 67/10* (2013.01)

(58) Field of Classification Search
CPC ..... A52B 69/0079; A63B 67/10
USPC ..... 473/423
See application file for complete search history.

(56) References Cited

U.S. PATENT DOCUMENTS 1,608,849 A * 11/1926 Gilmour ..... A63B 69/0079 473/575
2,458,668 A * 1/1949 Wood ..... A63B 67/10 473/514
2,506,825 A * 5/1950 Carlson ..... A63B 69/0079 473/575
3,107,094 A * 10/1963 Kfoury ..... A63B 69/0091 473/575
3,730,526 A * 5/1973 Litzka ..... A63B 69/0079 473/575
3,764,140 A * 10/1973 Lotfy ..... A63B 60/40 473/474
3,908,990 A * 9/1975 Spurgeon ..... A63B 69/0091 473/429
D246,130 S * 10/1977 Koblick ..... D21/309
4,093,225 A * 6/1978 Oliver ..... A63B 69/0079 473/575
4,188,033 A * 2/1980 Wells ..... A63B 69/0079 473/575
5,083,796 A * 1/1992 Norman ..... A63B 69/0079 473/575
5,957,789 A * 9/1999 Ainscough ..... A63B 69/0091 473/423
6,328,665 B1 * 12/2001 Gormley ..... E04H 12/2246 473/417
6,705,960 B2 * 3/2004 Gormley ..... A63B 69/0079 473/417
7,641,601 B2 * 1/2010 Jaet ..... A63B 69/222 482/83

(Continued)

*Primary Examiner* — Mitra Aryanpour
(74) *Attorney, Agent, or Firm* — QuickPatents; Kevin Prince

(57) ABSTRACT

A game system for playing on a horizontal surface includes vertical pole with a lower section telescopingly fixed with an aligned upper section. The lower section has a bottom end adapted for fixing with a base. An upper end of the lower section is adapted for receiving the upper section at a height adjustment mechanism. The base is adapted to engage the horizontal surface and may include a weight, a ground-penetrating spike, or the like. The upper section has a top end with a rigid implement connector adapted for receiving a playing implement. A flexible tether has an upper end fixed with the playing implement, and a lower end fixed with a sports ball. The playing implement may include a metallic coil spring, an extension rod, or other playing implement.

14 Claims, 7 Drawing Sheets

(56) References Cited

U.S. PATENT DOCUMENTS

| | | | | |
|---|---|---|---|---|
| 8,182,371 | B2 * | 5/2012 | Norman | A63B 71/0608 473/417 |
| 8,597,143 | B2 * | 12/2013 | Newman | A63B 69/0075 473/422 |
| 9,011,277 | B2 * | 4/2015 | Schell | A63B 69/002 473/422 |
| 9,724,582 | B2 * | 8/2017 | Burrell | A63B 69/0002 |
| D992,038 | S * | 7/2023 | Dwyer | D21/466 |
| D1,064,076 | S * | 2/2025 | Dwyer | D21/309 |
| 2005/0282664 | A1 * | 12/2005 | Beatty | A63B 69/002 473/446 |

* cited by examiner

TETHER BALL TYPE GAME SYSTEM

CROSS REFERENCE TO RELATED APPLICATIONS

This application claims the benefit of U.S. Provisional Patent Application 63/403,850, filed on Sep. 5, 2022, and incorporated herein by reference.

STATEMENT REGARDING FEDERALLY SPONSORED RESEARCH AND DEVELOPMENT

Not Applicable.

FIELD OF THE INVENTION

This invention relates to sporting games, and more particularly to a versatile tether ball sporting game.

BACKGROUND

Tether-based sports activities, such as tether ball, have been popular for decades. The success of the game of Zimm Zamm in the 1980's affirms the popularity of such tether based games, which have a relatively small footprint outdoors and are typically played by two people. However, such games typically only provide a single game to play, which after a while becomes mundane. Further, such games are typically only playable outdoors, and many require having a fixed location.

Therefore, there is a need for a tether game system that can provide the fun of various tether-based sports, such as Zimm-Zamm®, tether ball, and other games. Such a needed invention would allow for use both indoors and outdoors, and would be easily transported and set-up in new locations as needed. Such a needed game system would be able to be used with a tennis ball, a pickle ball, an American football, a golf ball, a baseball, a soccer ball, a tether ball, or the like. Further, such a needed invention could be used solo for training and practice. The present invention accomplishes these objectives.

SUMMARY OF THE INVENTION

The present device is a game system for playing on a horizontal surface, such as a ground surface outdoors, a floor surface indoors, or the like. A vertical pole has a lower section telescopingly fixed with an upper section. The lower section and the upper section are aligned along a common longitudinal axis. The lower section has a bottom end adapted for fixing with a base. An upper end of the lower section is adapted for receiving the upper section at a height adjustment mechanism. The base is adapted to engage the horizontal surface.

The base in some embodiments includes a weight that includes a central opening at a top end thereof for receiving the bottom end of the lower section of the vertical pole. The base in other embodiments includes a ground stake having a central opening at a top send thereof for receiving the bottom end of the lower section of the vertical pole. The ground stake has a ground-penetrating spike at a bottom end of the base adapted for penetrating into the horizontal surface, such as an outdoor lawn, sand, dirt, or the like.

The upper section has a top end with a rigid implement connector adapted for receiving a playing implement. The upper section further includes a bottom end adapted for telescopic connection with the top end of the lower section at the height adjustment mechanism. In some embodiments the implement connector includes a threaded aperture, the playing implement including a cooperative threaded shaft. As such, the playing implement is able to be screwed into the threaded aperture of the top end of the upper section of the vertical pole. Alternately the playing implement includes the threaded aperture and the top end of the upper section includes the threaded shaft.

A flexible tether, such as a nylon cord or the like, has an upper end fixed with the playing implement, and a lower end fixed with a sports ball. The sports ball may be, for example, a tennis ball, a pickle ball, an American football, a golf ball, a baseball, a soccer ball, a tether ball, or the like.

In preferred embodiments, the playing implement includes a metallic coil spring adapted to receive a loop at the upper end of the tether. As such, the sports ball can be hit in one direction to cause the loop at the upper end of the tether to travel upwardly along the coil spring as the sports ball spins about the coil spring. When hit in an opposing direction, the sports ball spins about the coil spring in the opposite direction, causing the loop to travel downwardly along the coil spring.

In preferred embodiments of the invention, the playing implement includes an extension rod that has a proximate end adapted for fixing with the implement connector of the upper end of the upper section of the vertical pole. A distal end of the extension rod is adapted for connecting with the upper end of the tether. The extension rod can be set at a selected angle with respect to the horizontal surface using a angle adjustment mechanism.

In some embodiments the game system includes a swivel mounted proximate the bottom end of the lower section of the vertical pole. A second tether is fixed with the swivel at a proximal end of the tether, the sports ball being fixed with a distal end of the tether. As such, sports balls such as the golf ball or the soccer ball may be attached to the second tether so that when struck, the sports ball spins around the vertical pole.

The present invention is a tether game system that provides the fun of various tether-based sports, such as Zimm-Zamm®, tether ball, and other games. The present game system allows for use both indoors and outdoors, and is easily transported and set-up in new locations as needed. The present invention is able to be used with a tennis ball, a pickle ball, an American football, a golf ball, a baseball, a soccer ball, a tether ball, or the like. Further, the present device can be used solo for training and practice. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known 6 structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
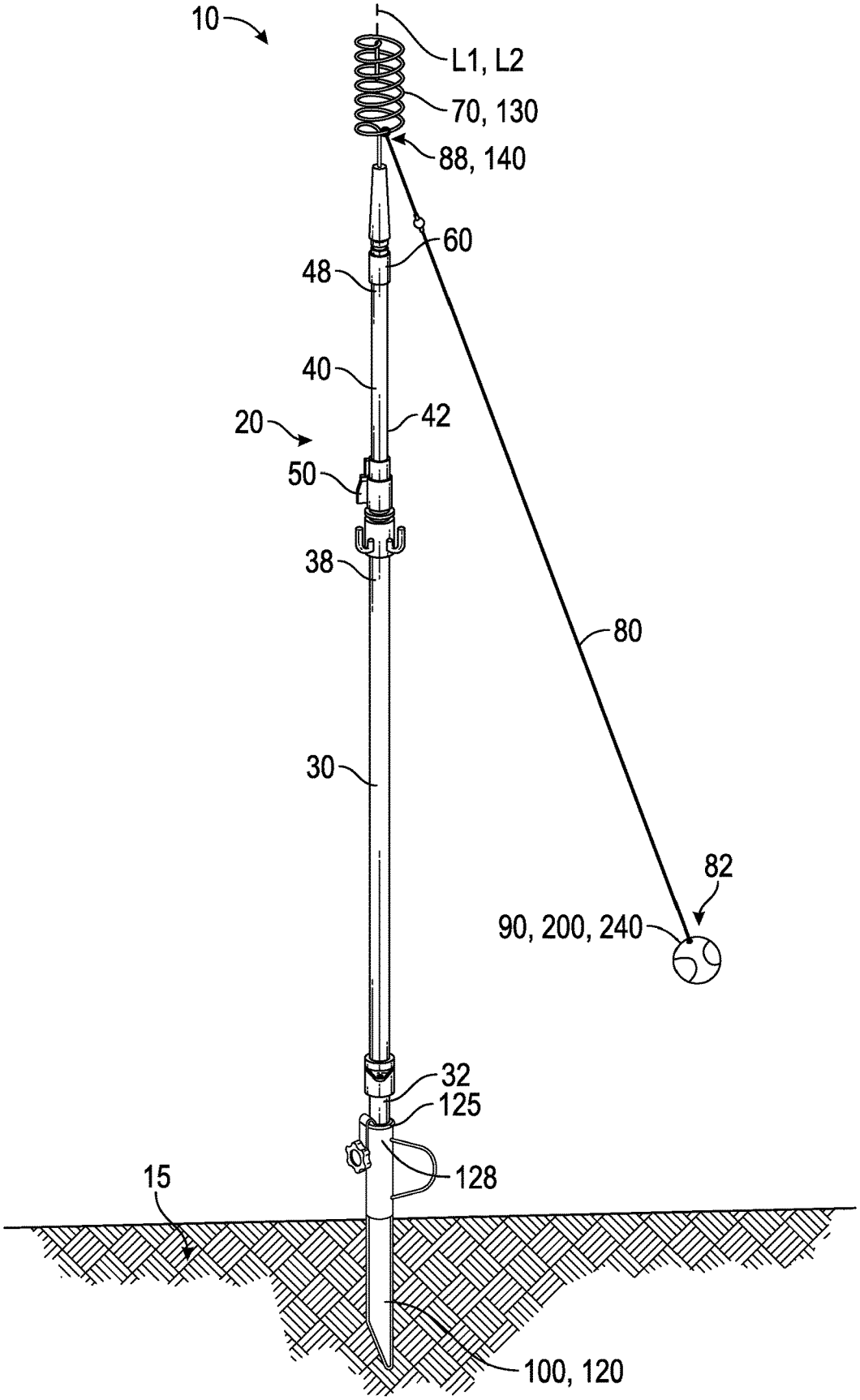
FIG. 1 is a perspective view of the invention, illustrating an embodiment having a ground stake for a base, a coil spring for a playing implement, and a tennis ball or baseball as a sports ball at a lower end of a tether.
Figure 2:
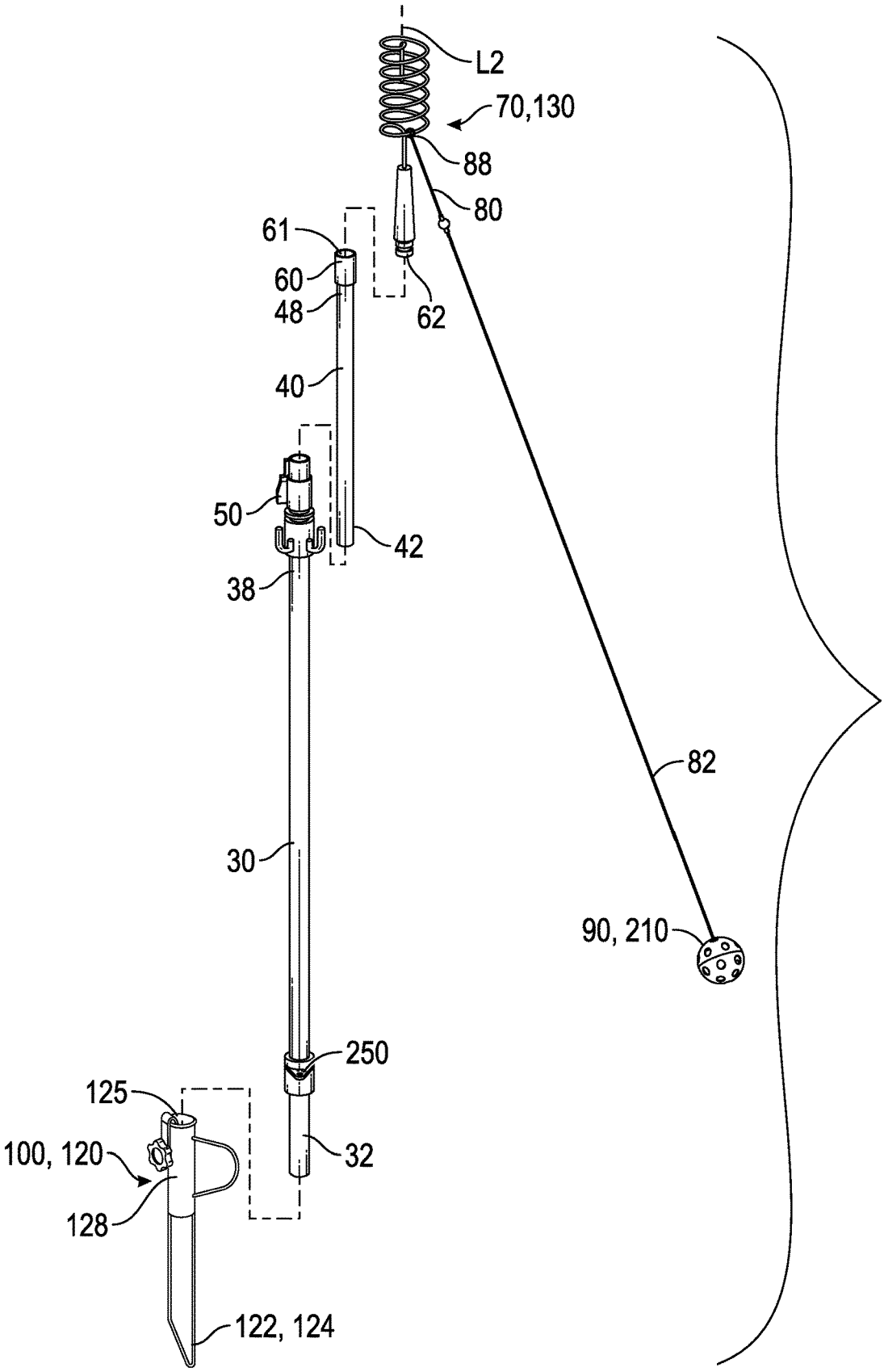
FIG. 2 is an exploded perspective view of the embodiment of FIG. 1, but for the sports ball being a pickleball instead of a tennis ball or a baseball.

FIGS. 1 and 2 illustrate a game system 10 for playing on a horizontal surface 15, such as a ground surface outdoors, a floor surface indoors, or the like. A vertical pole 20 has a lower section 30 telescopingly fixed with an upper section 40. The lower section 30 and the upper section 40 are aligned along a common longitudinal axis $L_1$. The lower section and upper section 40 are preferably made from a metal tube stock material, a relatively strong plastic or fiberglass material, or the like.

Figure 4:
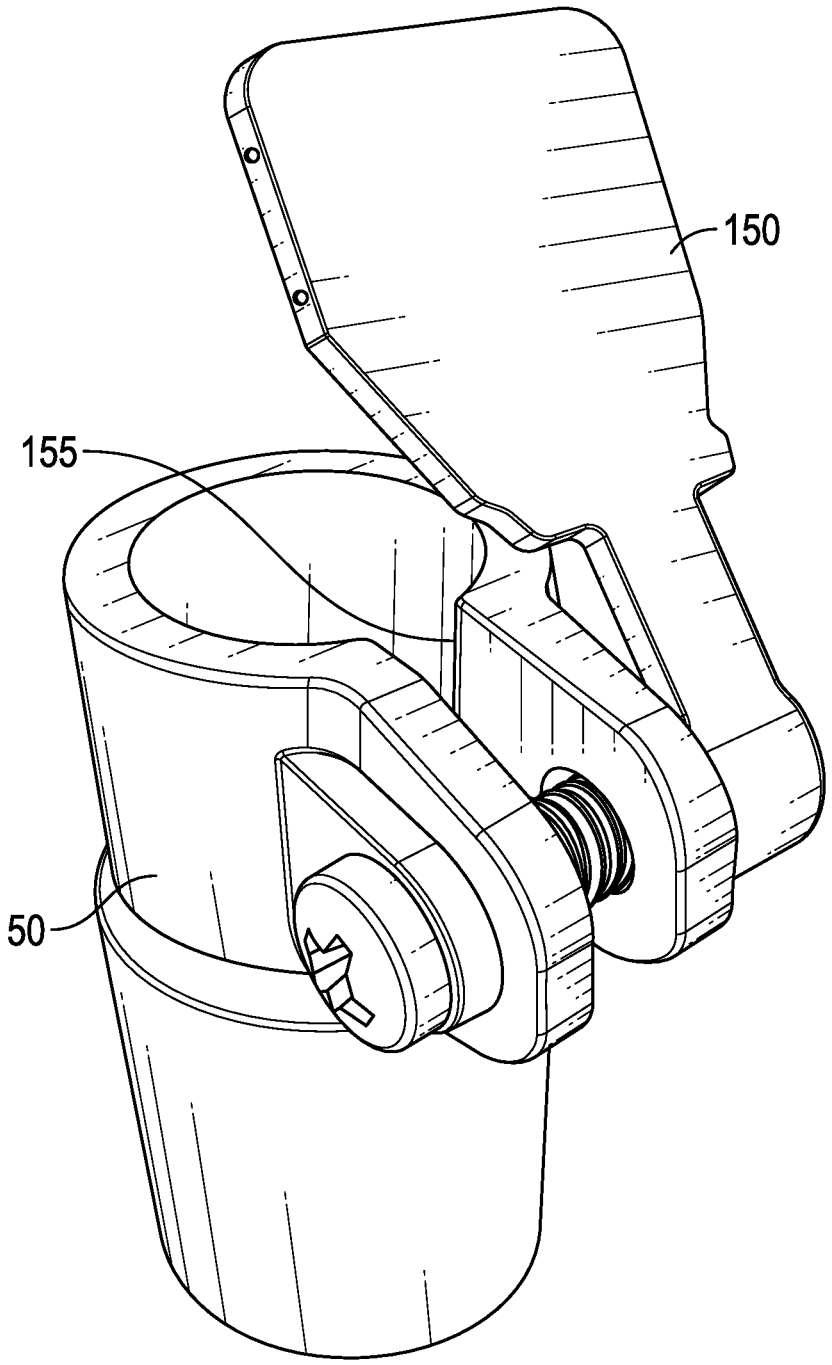
FIG. 4 is an enlarged perspective view of a height adjustment mechanism.

The lower section 30 has a bottom end 32 adapted for fixing with a base 100. An upper end 38 of the lower section 30 is adapted for receiving the upper section 40 at a height 9 adjustment mechanism 50 (FIG. 4). The base 100 is adapted to engage the horizontal surface 15.

The height adjustment mechanism 50 of the vertical pole 20 includes a cam lock lever 150 that, when in an engaged position, causes a cam 155 to press against the upper section 40 of the vertical pole 20 to lock the upper section 40 to the lower section 30, as is known in the art. When the cam lock lever 150 is in a released position the cam 155 retracts to allow the upper section 40 to be telescopingly adjusted with respect to the lower section 30. Alternately, other height adjustment mechanism 50 can be utilized, as 18 is known in the art. For example, the height adjustment mechanism 50 may include a rotationally actuated cam 160 that locks the upper section 40 to the lower section 30 when the upper section 40 is rotated in one direction with respect to the lower section 30. When the upper section 40 is rotated in an opposite direction, the upper section 40 is unlocked from the lower section 30.

Figure 6:
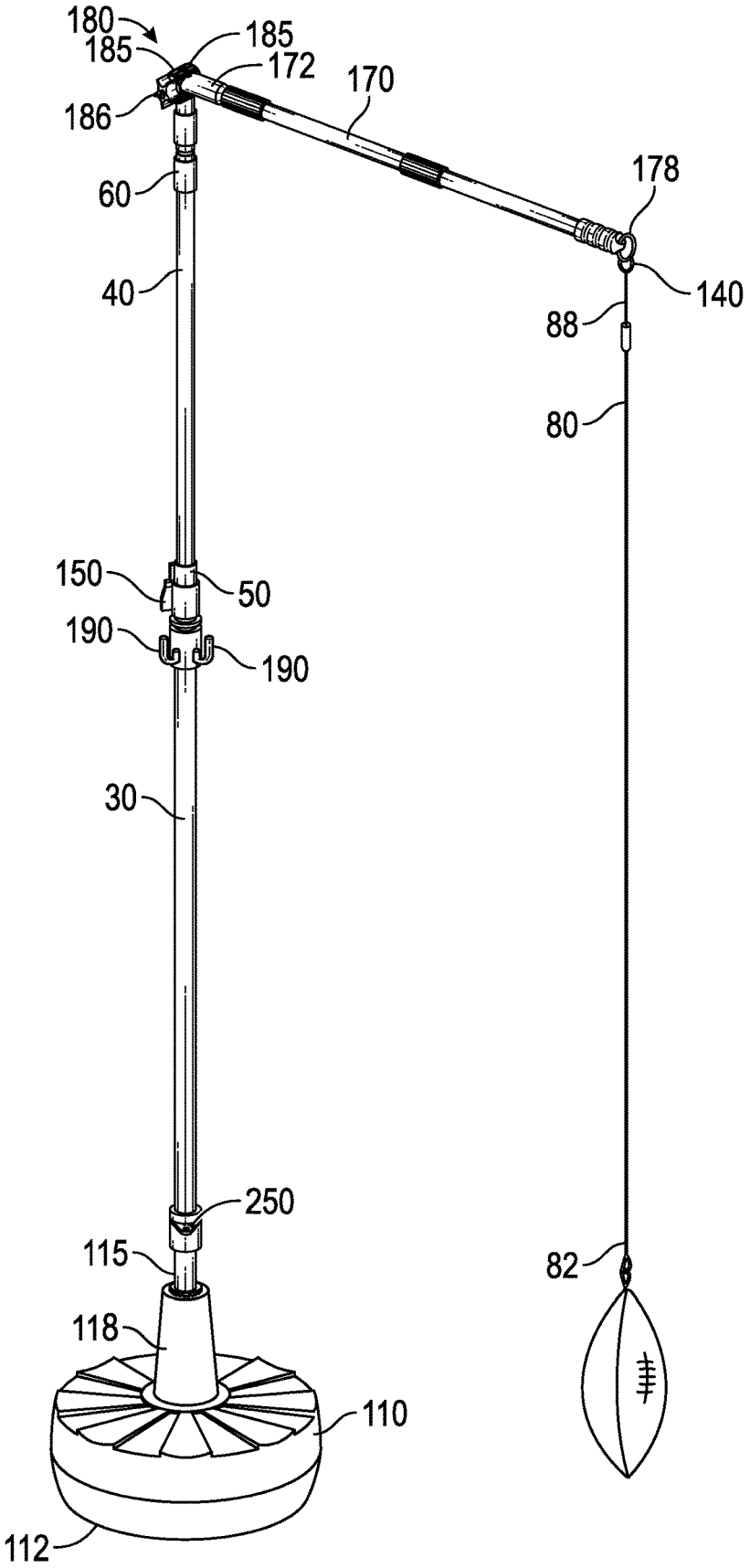
FIG. 6 is a perspective view of an embodiment having a weighted base, an extension rod, and an American football at the distal end of the tether.
Figure 7:
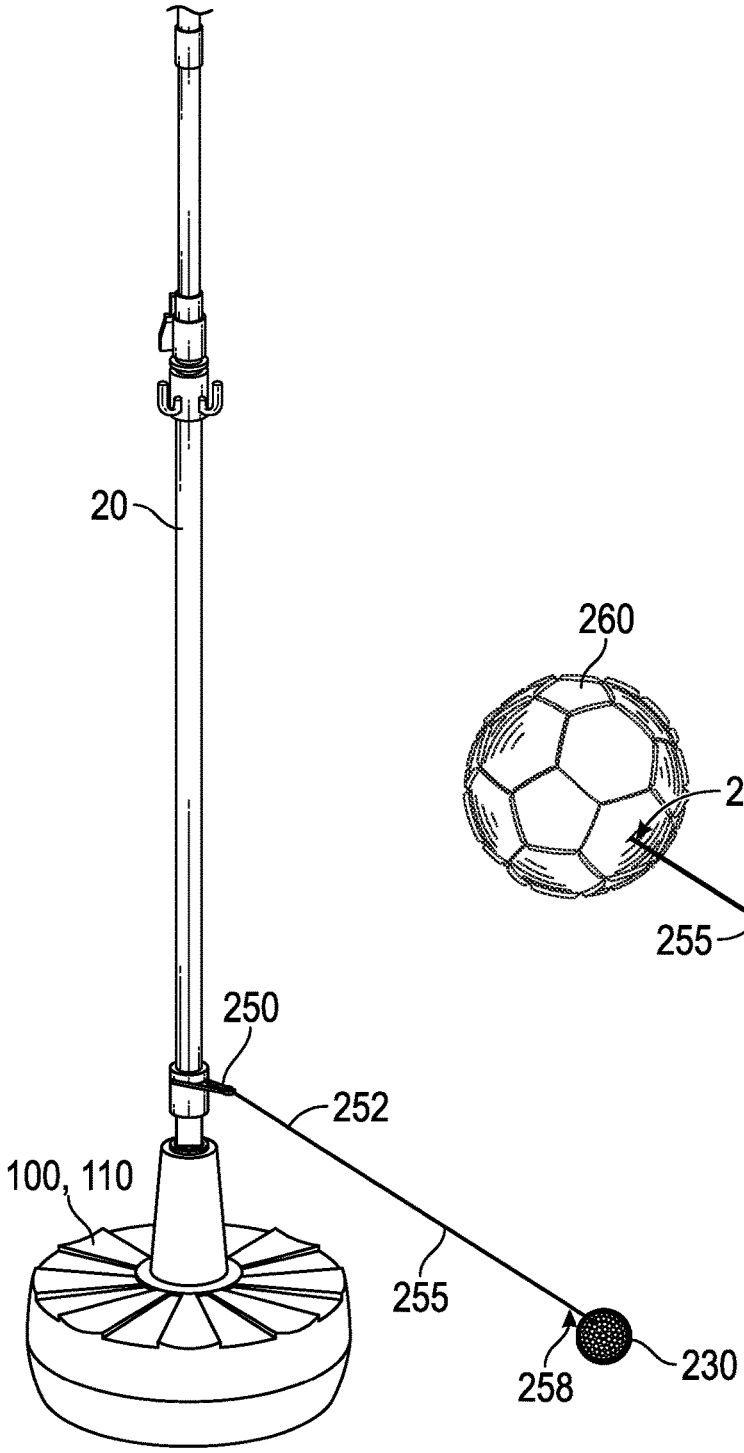
FIG. 7 is a perspective view of an alternate embodiment of the invention, illustrating a second tether fixed with a golf ball.
Figure 8:
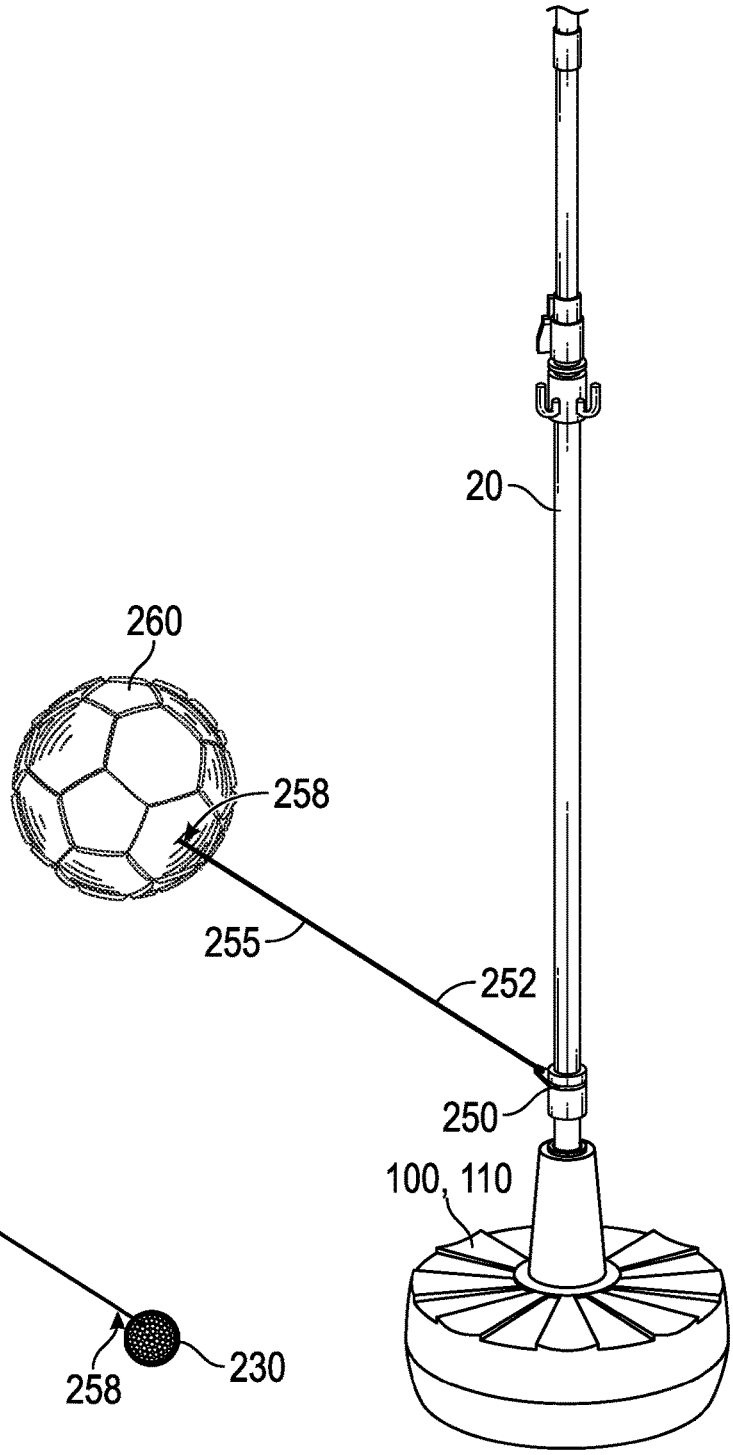
FIG. 8 is a perspective view of the alternate embodiment of the invention illustrated in FIG. 7, but for the sports ball being a soccer ball instead of a golf ball.

The base 100 in some embodiments includes a weight 110 (FIGS. 6-8) that includes a central opening 115 at a top end 118 thereof for receiving the bottom end 32 of the lower section 30 of the vertical pole 20. Such a weight 110 includes a flat bottom side 112 adapted for resting on the horizontal surface 15, and may include an outer plastic shell having an interior space for containing a relatively heavy material such as sand, water, or 6 the like.

The base 100 in other embodiments includes a ground stake 120 having a central opening at a top send 128 thereof for receiving the bottom end 32 of the lower section 30 of the vertical pole 20. The ground stake 120 has a metallic ground-penetrating spike 124 at a bottom end 122 of the base 100 adapted for penetrating into the horizontal surface 15, such as an outdoor lawn, sand, dirt, or the like.

Figure 3:
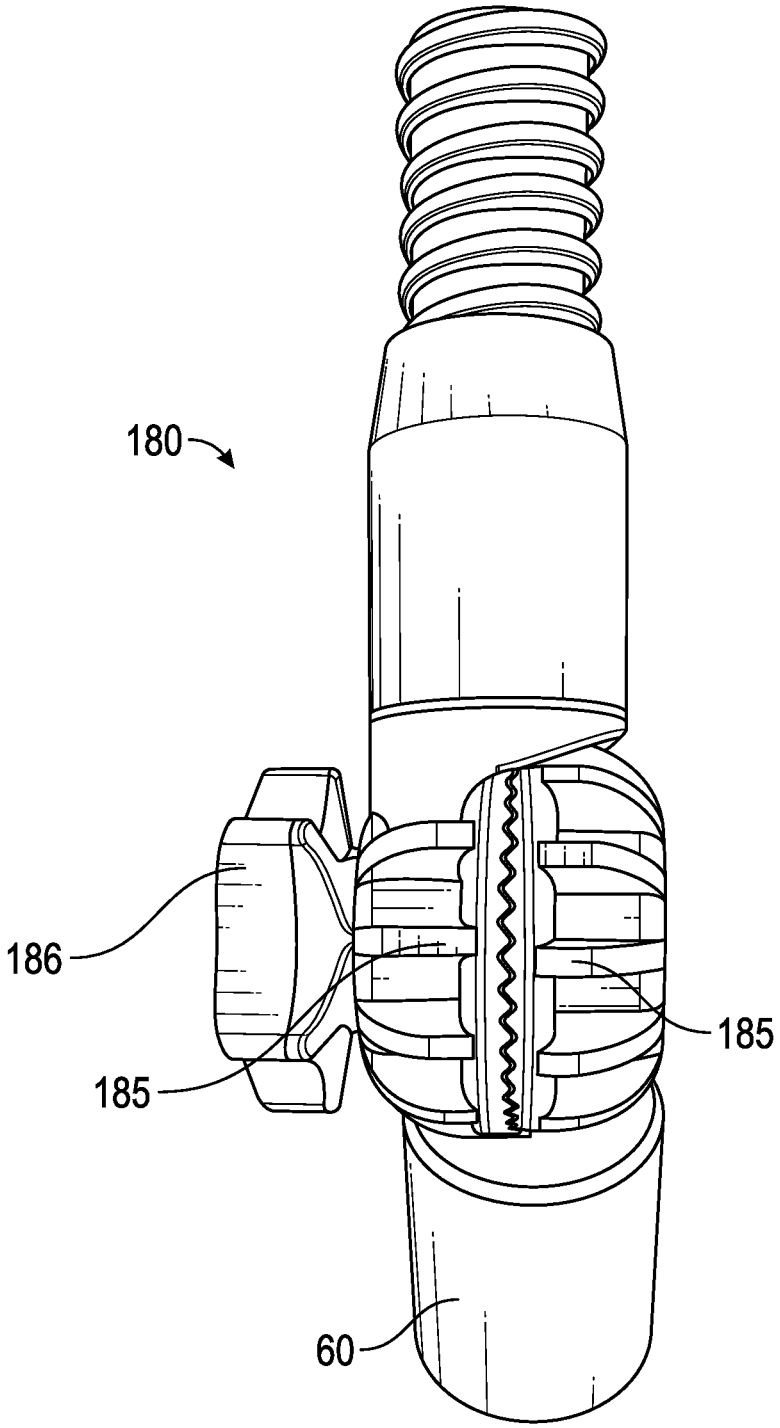
FIG. 3 is an enlarged rear view of an implement connector.
Figure 5:
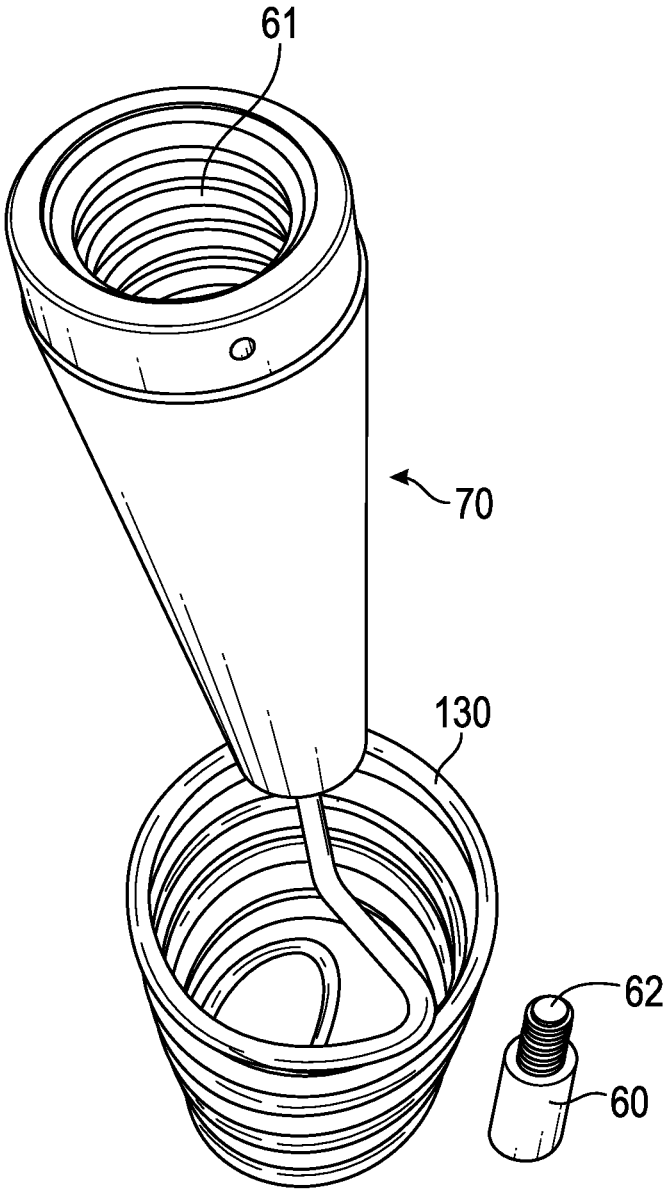
FIG. 5 is an inverted view of the coil spring playing implement.

The upper section 40 has a top end 48 with a rigid implement connector 60 (FIG. 3) adapted for receiving a playing implement 70 (FIG. 5). The upper section 40 further includes a bottom end 42 adapted for telescopic connection with the top end 38 of the lower section 30 at the height adjustment mechanism 50. In some embodiments the implement connector 60 includes a threaded aperture 61, the playing implement 70 including a cooperative threaded shaft 62. As such, the playing implement 70 is able to be screwed into the threaded aperture 61 of the top end 48 of the upper section 40 of the vertical pole 20. Alternately the playing implement 70 includes the threaded aperture 61 (FIG. 5) and the top end 48 of the upper section 40 includes the threaded shaft 62.

A flexible tether 80, such as a nylon cord or the like, has an upper end 88 fixed with the playing implement 70, and a lower end 82 fixed with a sports ball 90. The sports ball 90 may be, for example, a tennis ball 200 (FIG. 1), a pickle ball 210 (FIG. 2), an American football 220 (FIG. 6), a golf ball 230 (FIG. 7), a baseball 240 (FIG. 1), a soccer ball 260 (FIG. 8), a tether ball (not shown), or the like.

In preferred embodiments, the playing implement 70 includes a metallic coil spring 130 having a longitudinal axis $L_2$ that is aligned with the common longitudinal axis $L_1$ of the upper section 40 and the lower section 30 of the vertical pole 20. The coil spring 130 is adapted to receive a loop 140 at the upper end 88 of the tether 80. As such, the sports ball 90 can be hit in one direction to cause the loop 140 at the upper end 88 of the tether 80 to travel upwardly along the coil spring 130 as the sports ball 90 spins about the coil spring 130. When hit in an opposing direction, the sports ball 90 spins about the coil spring 130 in the opposite direction, causing the loop 140 to travel downwardly along the coil spring 130.

In preferred embodiments of the invention, the playing implement 70 includes a metal, plastic, or fiberglass extension rod 170 that has a proximal end 172 adapted for fixing with the implement connector 60 of the upper end 48 of the upper section 40 of the vertical pole 20. A distal end 178 of the extension rod 170 is adapted for connecting with the upper end 88 of the tether 80. One or more hooks 190 (FIG. 6) can be included, fixed with the vertical pole 20.

In such embodiments, preferably the extension rod 170 includes a rigid angle adjustment mechanism 180 comprising two radially ridged plates 185 that, when pressed together with a mechanical fastener 186, become rotationally locked together. When released by loosening the mechanical fastener 186, the two radially ridged plates may rotate with respect to each other. One of the plates 185 is connected with the implement connector 60, and the other plate 185 is connected with the proximal end 172 of the extension rod 170. Such an angle adjustment mechanism 180 is preferably made with injection molded plastic material.

In some embodiments the game system 10 includes a swivel 250 (FIGS. 7 and 8) mounted proximate the bottom end 32 of the lower section 30 of the vertical pole 20. A second tether 255 may be fixed with the swivel 250 at a proximal end 252 of the second tether 255, the sports ball 90 being fixed with a distal end 258 of the second tether 255. As such, sports balls such as the golf ball 230 or the soccer ball 260 may be attached to the second tether 255 so that when struck, the sports ball 90 spins around the vertical pole 20.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A game system for playing on a horizontal surface, comprising:

a vertical pole having a lower section telescopingly fixed with an upper section, the lower section and upper section aligned along a common longitudinal axis;

the lower section having a bottom end adapted for fixing with a base, the base adapted to engage the horizonal surface, an upper end adapted for receiving the upper section at a height adjustment mechanism;

the upper section having a top end with an implement connector adapted for receiving a playing implement, and a bottom end adapted for telescopic connection with the top end of the lower section at the height adjustment mechanism; and a tether having an upper end fixed with the playing implement and a lower end fixed with a sports ball;

wherein the playing implement is an extension rod that has a proximate end adapted for fixing with the implement connector of the upper end of the vertical pole, and a distal end adapted for connecting with the upper end of the tether; and wherein the extension rod includes an angle adjustment mechanism comprising two radially ridged plates that when pressed together with a mechanical fastener become rotationally locked together, and when released by loosening the mechanical fastener allow for mutual rotational movement between the two radially ridged plates, one of the radially ridged plates connected with the implement connector and another of the radially ridged plates connected with the proximal end of the extension rod.

2. The game system of claim 1 wherein the base is a weight having a central opening at a top end thereof for receiving the bottom end of the lower section of the vertical pole, and a flat bottom side adapted for resting on the horizontal surface.

3. The game system of claim 1 wherein the base is a ground stake having a central opening at a top end thereof for receiving the bottom end of the lower section of the vertical pole, and a ground-penetrating spike at a bottom end of the base adapted for penetrating into the horizontal surface.

4. The game system of claim 1 wherein the implement connector includes a threaded aperture, and wherein the playing implement includes a cooperative threaded shaft, the playing implement being able to be screwed into the threaded aperture of the top end of the upper section of the vertical pole.

5. The game system of claim 1 wherein the height adjustment mechanism of the vertical pole includes a cam lock lever that, when in an engaged position, causes a cam to press against the upper section of the vertical pole to lock the upper section to the lower section, and when in a released position allows the upper section to be telescopingly adjusted with respect to the lower section.

6. The game system of claim 1 wherein the height adjustment mechanism of the vertical pole includes a rotationally actuated cam that locks the upper section to the lower section when the upper section is rotated in one direction with respect to the lower section, and unlocks the upper section from the lower section when the upper section is rotated in an opposing direction.

7. The game system of claim 1 further include one or more hooks fixed with the vertical pole.

8. The game system of claim 1 wherein the sports ball is a tennis ball.

9. The game system of claim 1 wherein the sports ball is a pickle ball.

10. The game system of claim 1 wherein the sports ball is a football.

11. The game system of claim 1 wherein the sports ball is a golf ball.

12. The game system of claim 1 wherein the sports ball is a baseball.

13. The game system of claim 1 further including a swivel fixed with the vertical pole, the swivel fixed at a proximal end to a second tether, a distal end of the second tether fixed with one of the sports balls.

14. A game system for playing on a horizontal surface, comprising:

a vertical pole having a lower section telescopingly fixed with an upper section, the lower section and upper section aligned along a common longitudinal axis;

the lower section having a bottom end adapted for fixing with a base, the base adapted to engage the horizonal surface, an upper end adapted for receiving the upper section at a height adjustment mechanism;

the upper section having a top end with an implement connector adapted for receiving a playing implement, and a bottom end adapted for telescopic connection with the top end of the lower section at the height adjustment mechanism;

the base including either a weight having a central opening at a top end thereof for receiving the bottom end of the lower section of the vertical pole, and a flat bottom side adapted for resting on the horizontal surface; or the base including a ground stake having a central opening at a top end thereof for receiving the bottom end of the lower section of the vertical pole, and a ground-penetrating spike at a bottom end of the base adapted for penetrating into the horizontal surface;

a tether having an upper end fixed with the playing implement and a lower end fixed with a sports ball; and one or more hooks fixed with the vertical pole;

wherein the implement connector includes a threaded aperture, and wherein the playing implement includes a cooperative threaded shaft, the playing implement being able to be screwed into the threaded aperture of the top end of the upper section of the vertical pole;

wherein the playing implement includes an extension rod that has a proximate end adapted for fixing with the implement connector of the upper end of the vertical pole, and a distal end adapted for connecting with the upper end of the tether, such extension rod including an angle adjustment mechanism comprising two radially ridged plates that when pressed together with a mechanical fastener become rotationally locked together, and when released by loosening the mechanical fastener allow for mutual rotational movement between the two radially ridged plates, one of the radially ridged plates connected with the implement connector and another of the radially ridged plates connected with the proximal end of the extension rod;

wherein the height adjustment mechanism of the vertical pole includes a cam lock lever that, when in an engaged position, causes a cam to press against the upper section of the vertical pole to lock the upper section to the lower section, and when in a released position allows the upper section to be telescopingly adjusted with respect to the lower section;

the sports ball selected from the group consisting of: a tennis ball, a pickle ball, a football, a golf ball, and a baseball.

* * * * *